US008238767B2

(12) United States Patent
Kawarazuka et al.

(10) Patent No.: US 8,238,767 B2
(45) Date of Patent: Aug. 7, 2012

(54) VISUALIZING AGENT QUANTITY DISPLAY SYSTEM, IMAGE FORMING APPARATUS, IMAGE FORMING SYSTEM AND COMPUTER READABLE MEDIUM

(75) Inventors: Hiroshi Kawarazuka, Saitama (JP); Hiroaki Kumai, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1190 days.

(21) Appl. No.: 11/874,514

(22) Filed: Oct. 18, 2007

(65) Prior Publication Data

US 2008/0273047 A1 Nov. 6, 2008

(30) Foreign Application Priority Data

Nov. 30, 2006 (JP) ..... 2006-324565

(51) Int. Cl.
*G03G 15/08* (2006.01)

(52) U.S. Cl. ..... 399/27

(58) Field of Classification Search ..... 399/27
See application file for complete search history.

(56) References Cited

U.S. PATENT DOCUMENTS 3,712,203 A * 1/1973 Kishi et al. ..... 396/570
4,937,627 A * 6/1990 Ozawa et al. ..... 399/224
5,305,063 A 4/1994 Marumoto
5,532,791 A * 7/1996 Takahashi et al. ..... 399/18
5,594,529 A * 1/1997 Yamashita et al. ..... 399/8
5,652,947 A * 7/1997 Izumizaki ..... 399/58
5,801,315 A * 9/1998 Park et al. ..... 73/861.57
5,943,525 A * 8/1999 Endo et al. ..... 399/27
6,122,459 A * 9/2000 Ogasawara ..... 399/27
6,325,479 B1 12/2001 Nakamura et al.
6,381,420 B1 * 4/2002 Sato et al. ..... 399/27
6,546,212 B1 * 4/2003 Ogata et al. ..... 399/24
6,587,649 B1 7/2003 Yamamoto et al.
7,058,320 B2 * 6/2006 Yamamoto et al. ..... 399/27
7,493,857 B2 * 2/2009 Sasayama ..... 101/484
8,064,784 B2 * 11/2011 Inoue et al. ..... 399/24

(Continued)

FOREIGN PATENT DOCUMENTS

CN 1218025 A 6/1999

(Continued)

OTHER PUBLICATIONS

English machine translation of Japanese document Kurihara (JP 2004-354463 A).*

(Continued)

*Primary Examiner* — David Gray
*Assistant Examiner* — Geoffrey Evans
(74) *Attorney, Agent, or Firm* — Sughrue Mion, PLLC

(57) ABSTRACT

A visualizing agent quantity display control system includes a first container, a second container, a detection unit, a display unit, a control unit. The second container, which is replaceable, contains the visualizing agent to be supplied to the first container. The detection unit detects a quantity of the visualizing agent contained in the second container. The control unit causes the detection unit to detect a remaining quantity of the visualizing agent in the second container except the visualizing agent which decreases when an operation of supplying the visualizing agent in the second container to the first container has first been executed. The control unit causes a display unit to display information indicating that the remaining quantity of the visualizing agent in the second container is full regardless of the quantity of the visualizing agent which decreases when the operation has first been executed.

6 Claims, 11 Drawing Sheets

U.S. PATENT DOCUMENTS

| | | | | |
|---|---|---|---|---|
| 8,086,115 | B2 * | 12/2011 | Yamasaki et al. | 399/8 |
| 8,139,962 | B2 * | 3/2012 | Koizumi et al. | 399/30 |
| 2005/0220465 | A1 * | 10/2005 | Yamaoka et al. | 399/35 |
| 2006/0083553 | A1 | 4/2006 | Makino | |
| 2006/0280513 | A1 * | 12/2006 | Hatakeyama | 399/27 |

FOREIGN PATENT DOCUMENTS

| | | | |
|---|---|---|---|
| CN | 1296199 | A | 5/2001 |
| CN | 1763646 | A | 4/2006 |
| JP | 5-127522 | A | 5/1993 |
| JP | 8238781 | A | 9/1996 |
| JP | 2002-244423 | A | 8/2002 |
| JP | 2002-357945 | A | 12/2002 |
| JP | 2004-354463 | A | 12/2004 |

OTHER PUBLICATIONS

English *human* translation of Japanese document Kurihara et al. (JP 2004-354463 A).*

Communication dated Feb. 17, 2011, issued in corresponding Chinese Patent Application No. 200710151449.8.

Japanese Office Action dated Feb. 9, 2012 issued in Japanese Application 2006-324565.

* cited by examiner

VISUALIZING AGENT QUANTITY DISPLAY SYSTEM, IMAGE FORMING APPARATUS, IMAGE FORMING SYSTEM AND COMPUTER READABLE MEDIUM

BACKGROUND

1. Technical Field

The present invention relates to a visualizing agent quantity display system, an image forming apparatus, an image forming system and a computer readable medium.

2. Related Art

Conventionally, as an example of an image forming device such as a laser printer and an ink-jet printer, an image forming device was known in which a visualizing agent such as a toner or an ink is contained in a container, that is detachably installed in the image forming device and the container is exchanged with a new container, when the visualizing agent contained in the presently installed container is used up.

SUMMARY

According to an aspect of the invention, a visualizing agent quantity display control system includes a first container, a second container, a detection unit, a display unit, a control unit. The first container contains a visualizing agent which decreases with an operation of forming a visible image on a recording medium. The second container contains the visualizing agent to be supplied to the first container. The visualizing agent contained in the second container decreases with an operation of supplying the visualizing agent from the second container to the first container.

The second container is detachably attached to a predetermined unit in which the first container is disposed. The detection unit detects a quantity of the visualizing agent contained in the second container. The display unit displays the quantity of the visualizing agent in the second container, which is detected by the detection unit. The control unit causes the detection unit to detect a remaining quantity of the visualizing agent in the second container except the visualizing agent which decreases when the operation of supplying the visualizing agent contained in the second container to the first container has first been executed. The control unit causes a display unit to display information indicating that the remaining quantity of the visualizing agent in the second container is full regardless of the quantity of the visualizing agent which decreases when the operation of supplying the visualizing agent contained in the second container to the first container has first been executed.

BRIEF DESCRIPTION OF THE DRAWINGS

Exemplary embodiments of the invention will be described below in detail based on the following figures, wherein.

DETAILED DESCRIPTION

Figure 1:
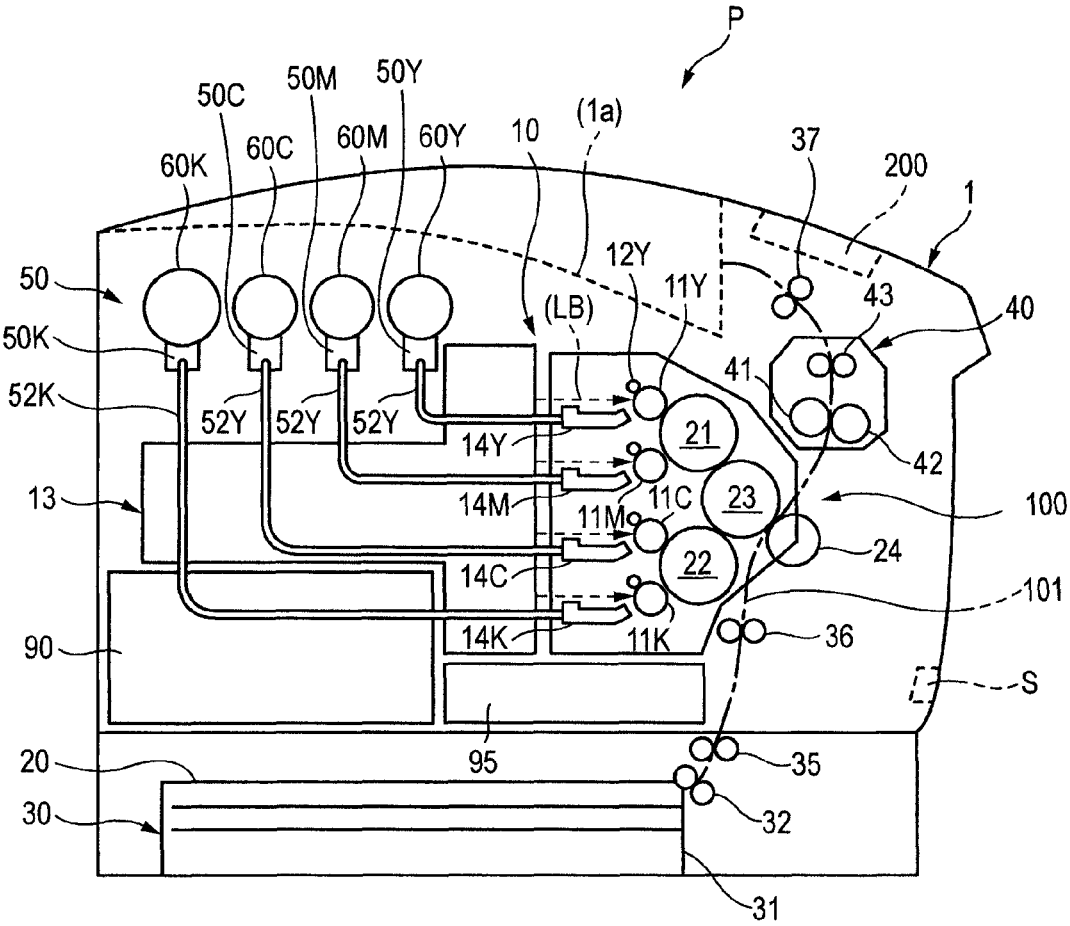
FIG. 1 is a diagram illustrating the overall (entire) configuration of a full-color printer as an image forming device according to an exemplary embodiment of the present invention.

Hereinafter, exemplary embodiments of the present invention will be described in detail with reference to the attached drawings. Herein, the same components in the attached drawings are denoted by the same reference numerals and the detailed descriptions thereof will be omitted. Since the following descriptions are based on the best mode for carrying out the invention, the invention is not restricted to this.

Figure 2A:
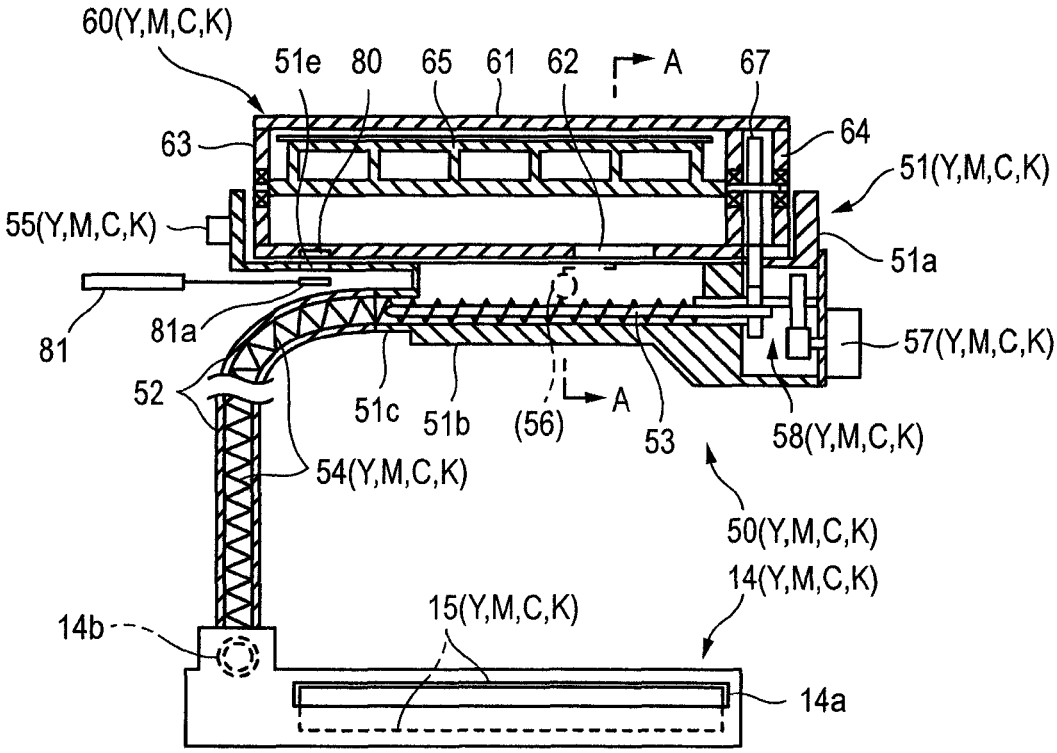
FIG. 2A is a schematic sectional view illustrating a toner cartridge, a toner supply device, and a developing unit.
Figure 2B:
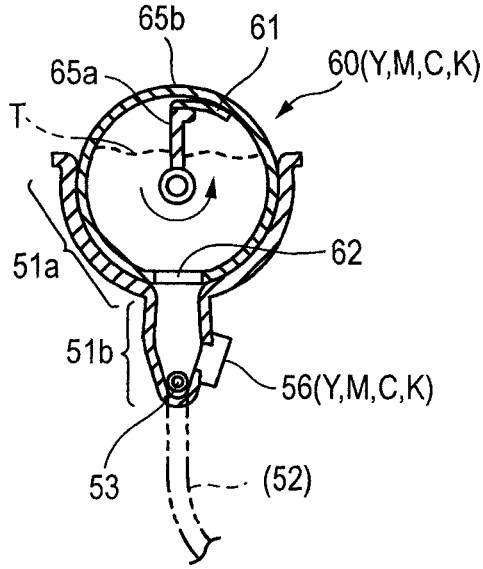
FIG. 2B is a sectional view taken along the line A-A of FIG. 2A.
Figure 3:
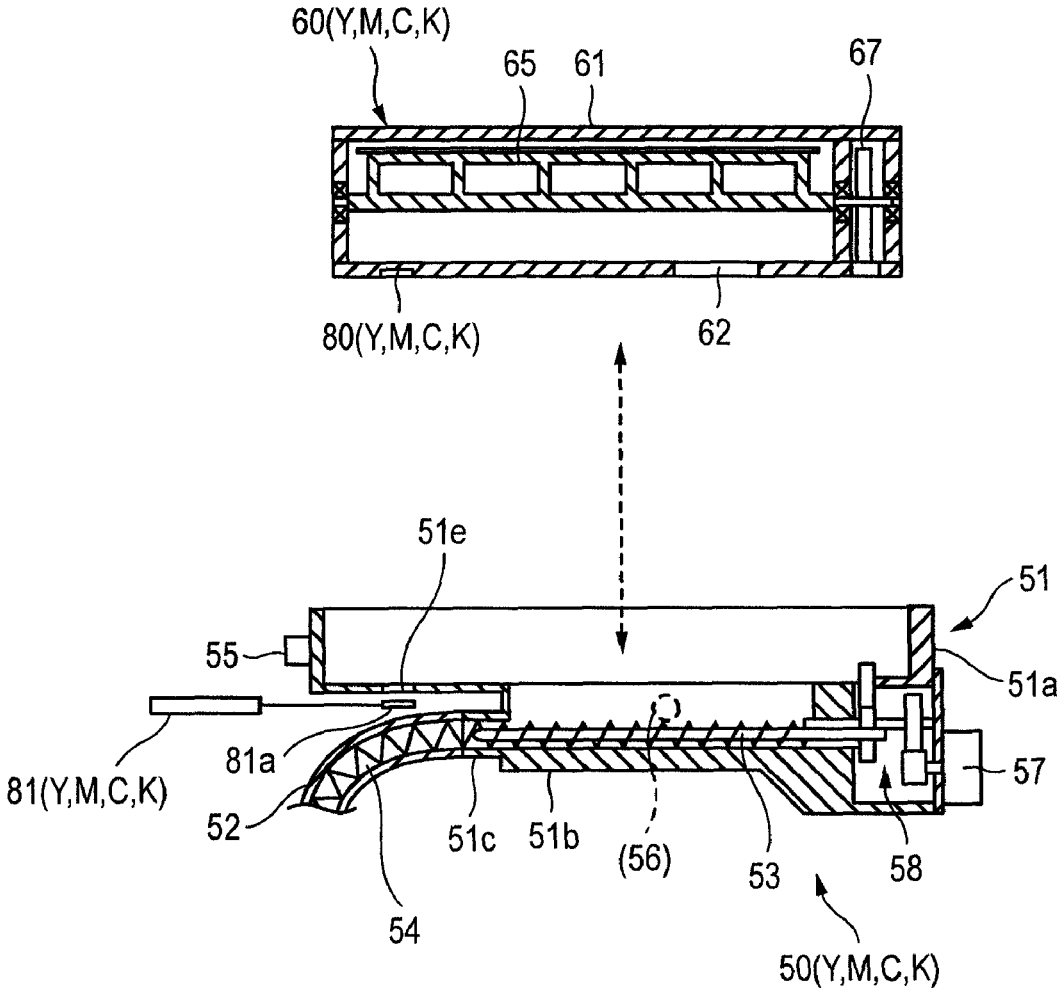
FIG. 3 is a schematic sectional view illustrating a state where the toner cartridge is separated from the toner supply device.
Figure 4:
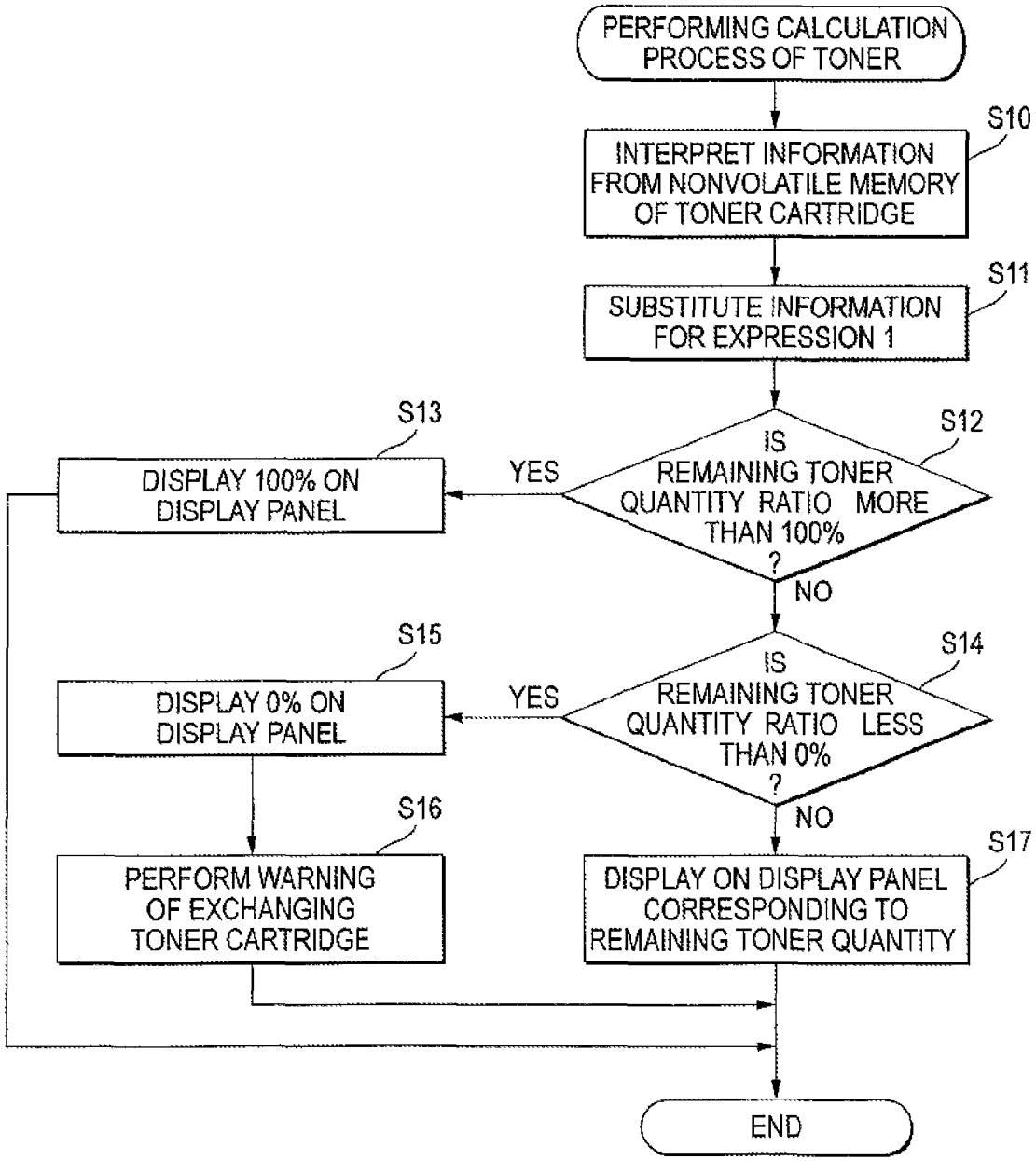
FIG. 4 is a flow chart illustrating a process sequence of a process of calculating a remaining toner quantity.
Figure 5:
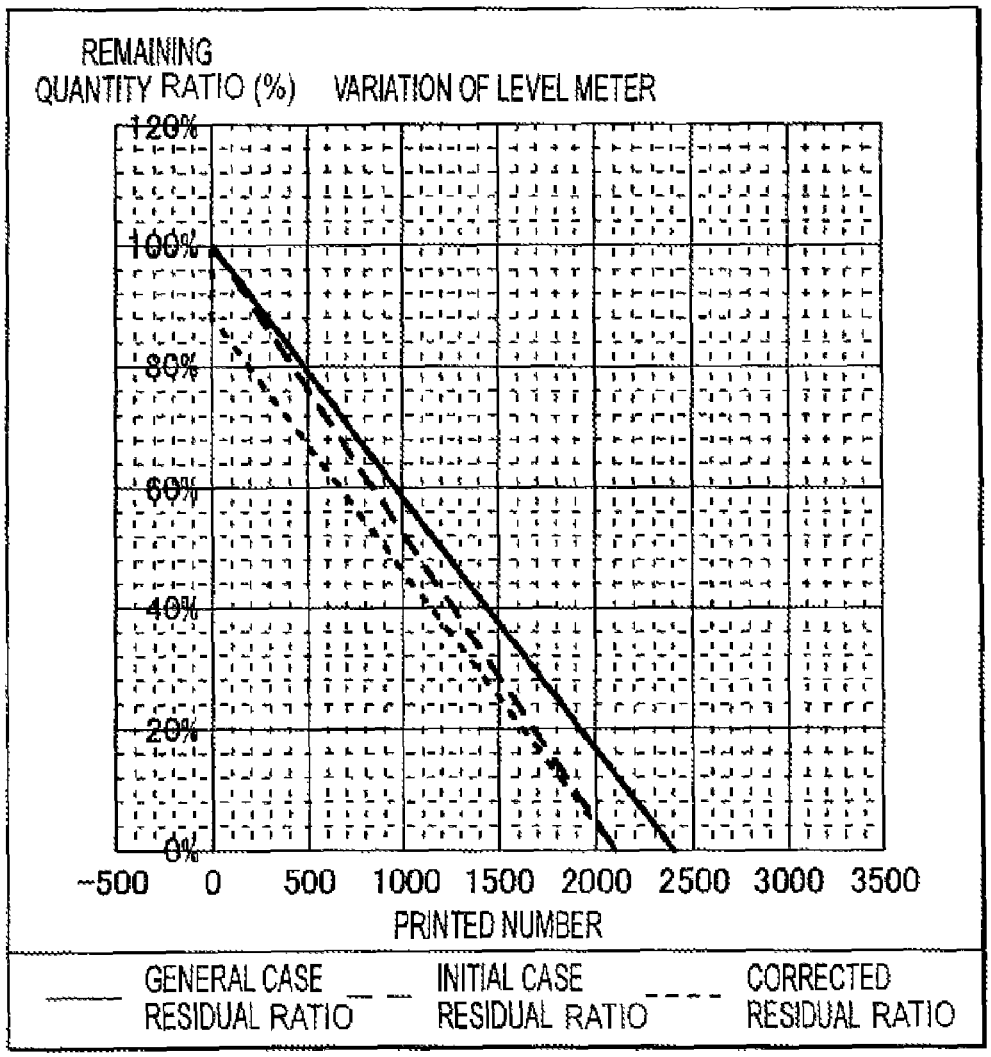
FIG. 5 is a graph illustrating the variation of a level meter of the remaining toner quantity.
Figure 6:
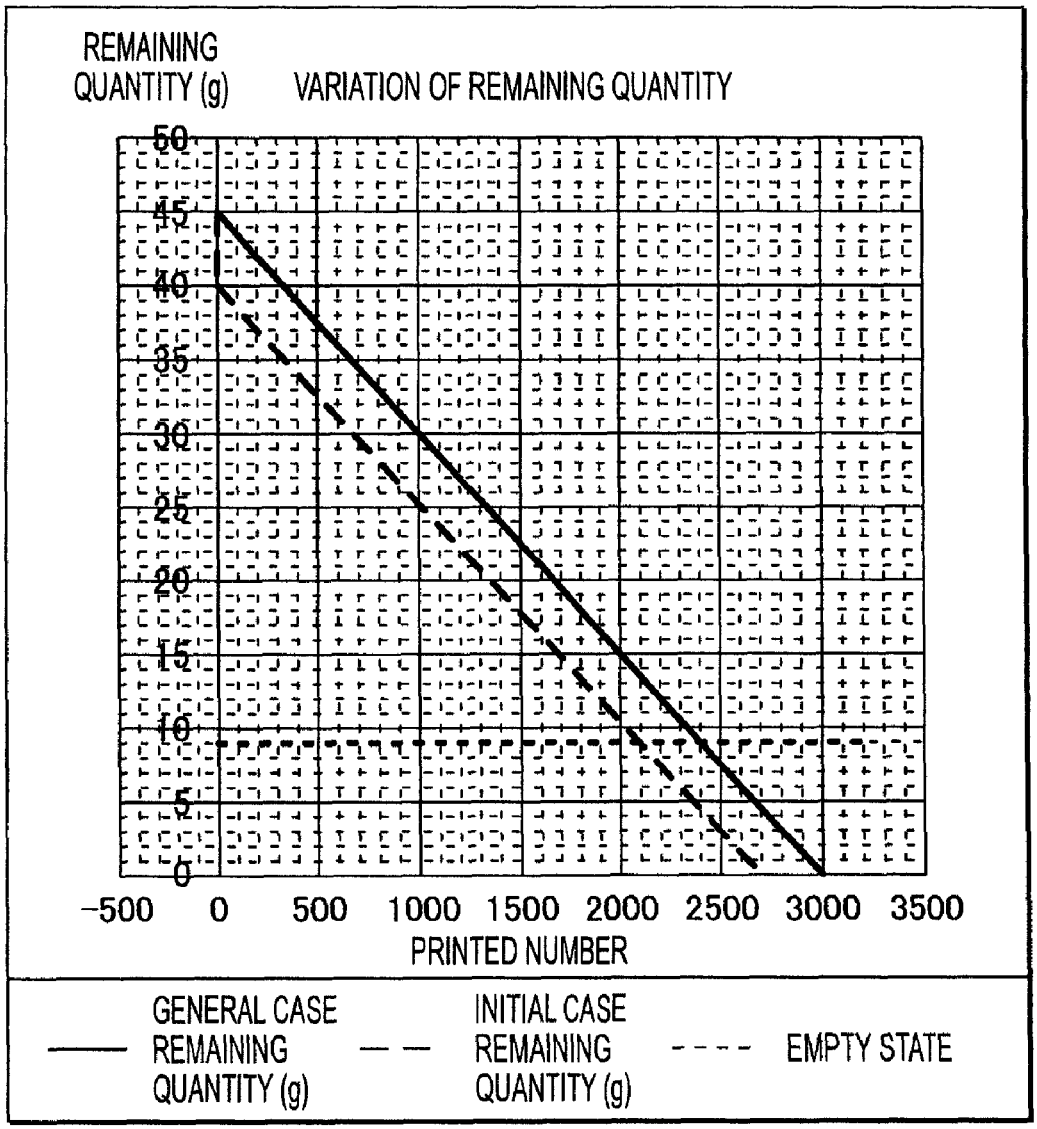
FIG. 6 is a graph illustrating the variation of the remaining toner quantity.
Figure 7:
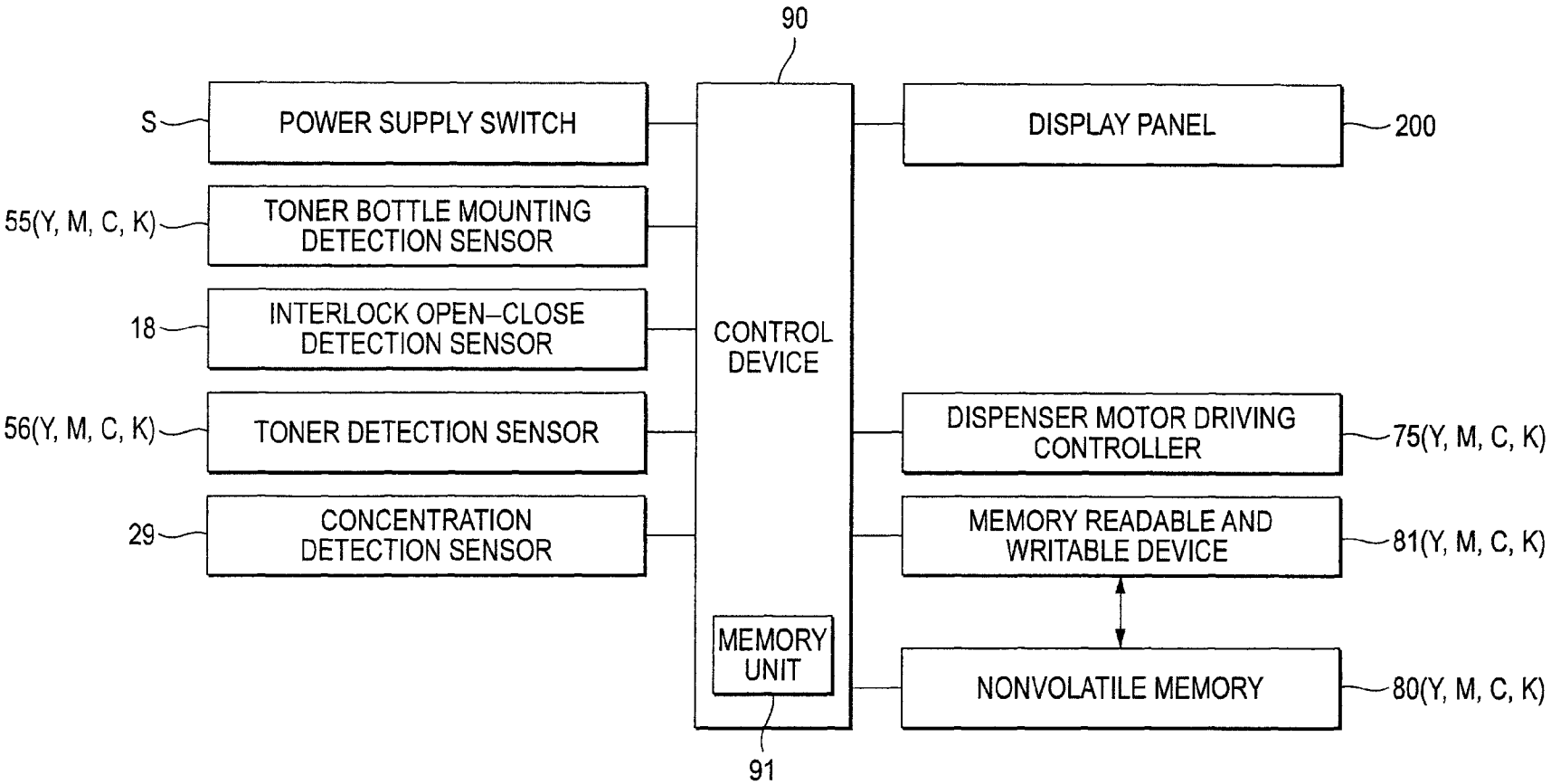
FIG. 7 is a block diagram illustrating a configuration of a control system which controls a supply of the toner and the state of the toner cartridge.
Figure 8:
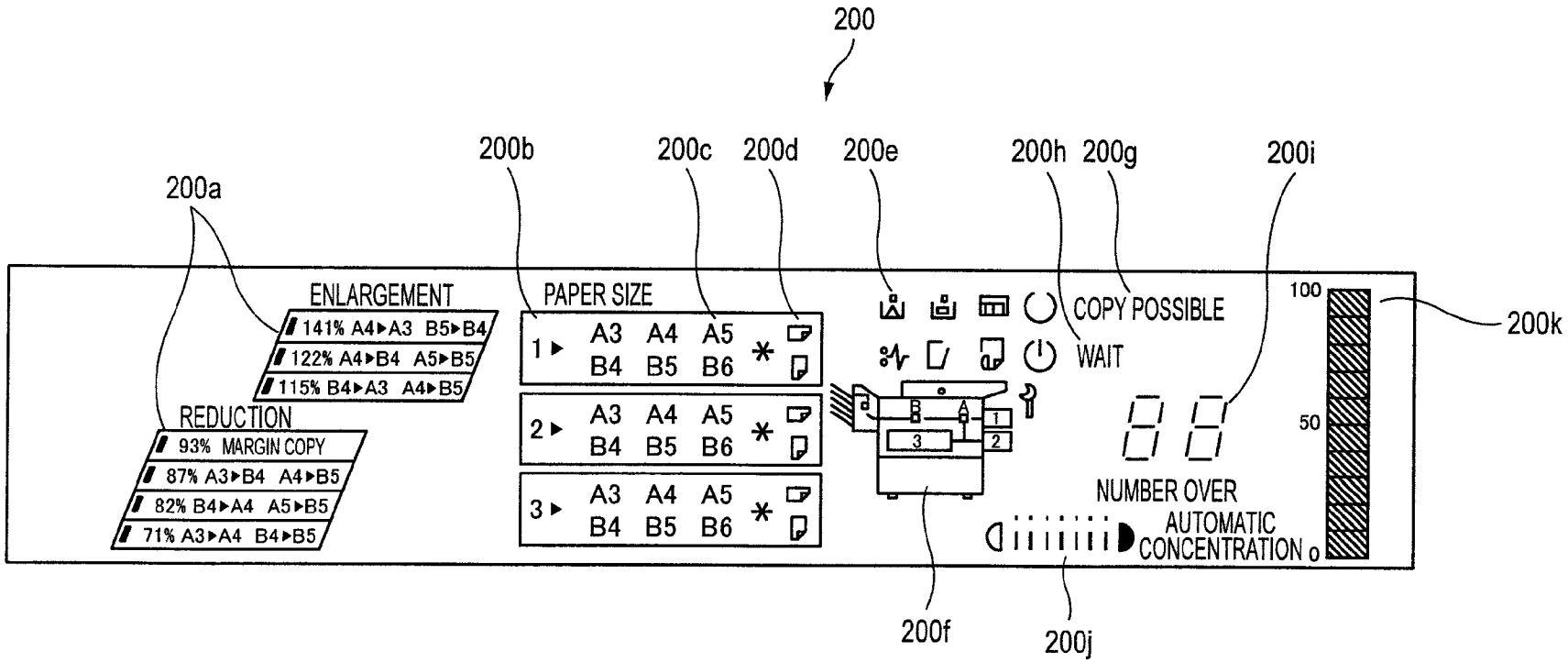
FIG. 8 is an explanatory view illustrating a display example on a display panel.
Figure 9:
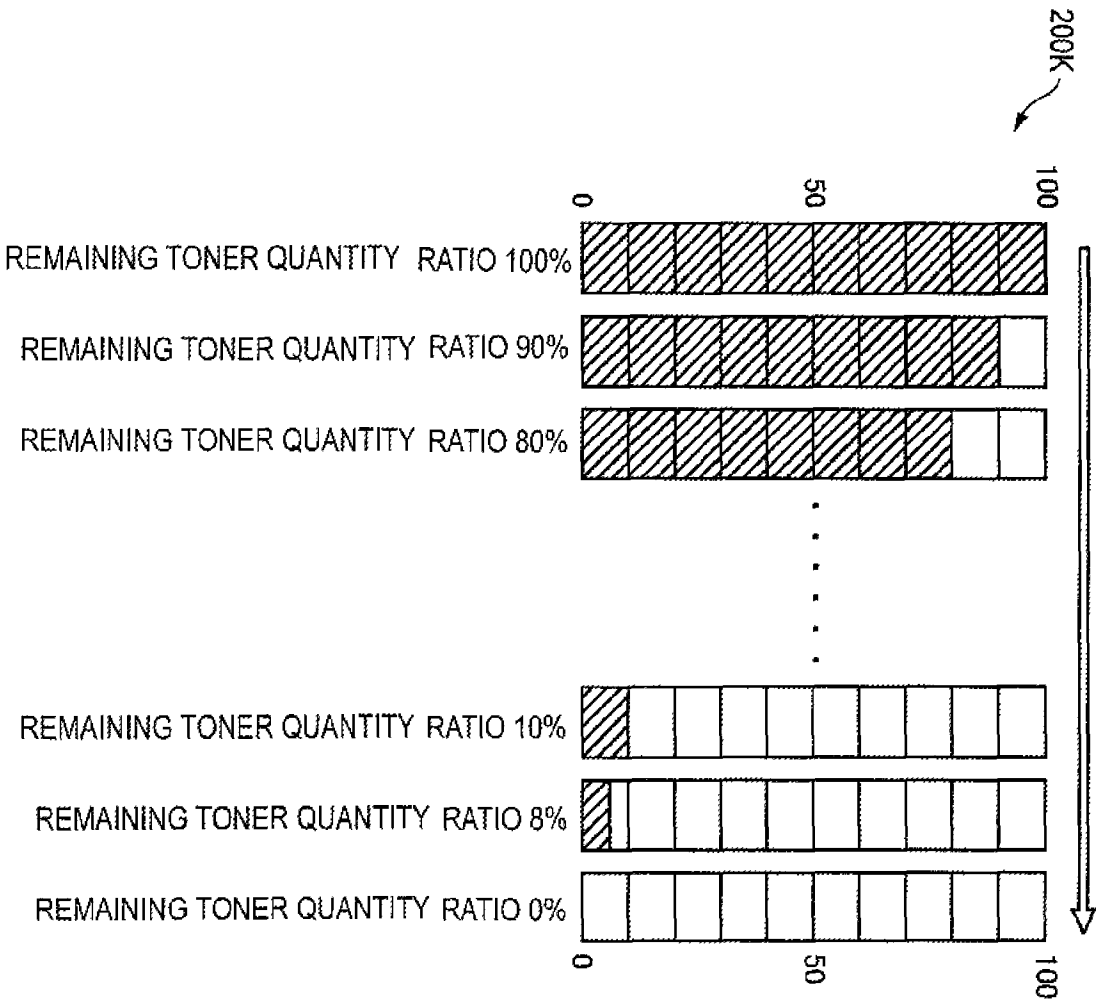
FIG. 9 is an explanation view illustrating a display example of the variation state of the toner remaining quantity.
Figure 10:
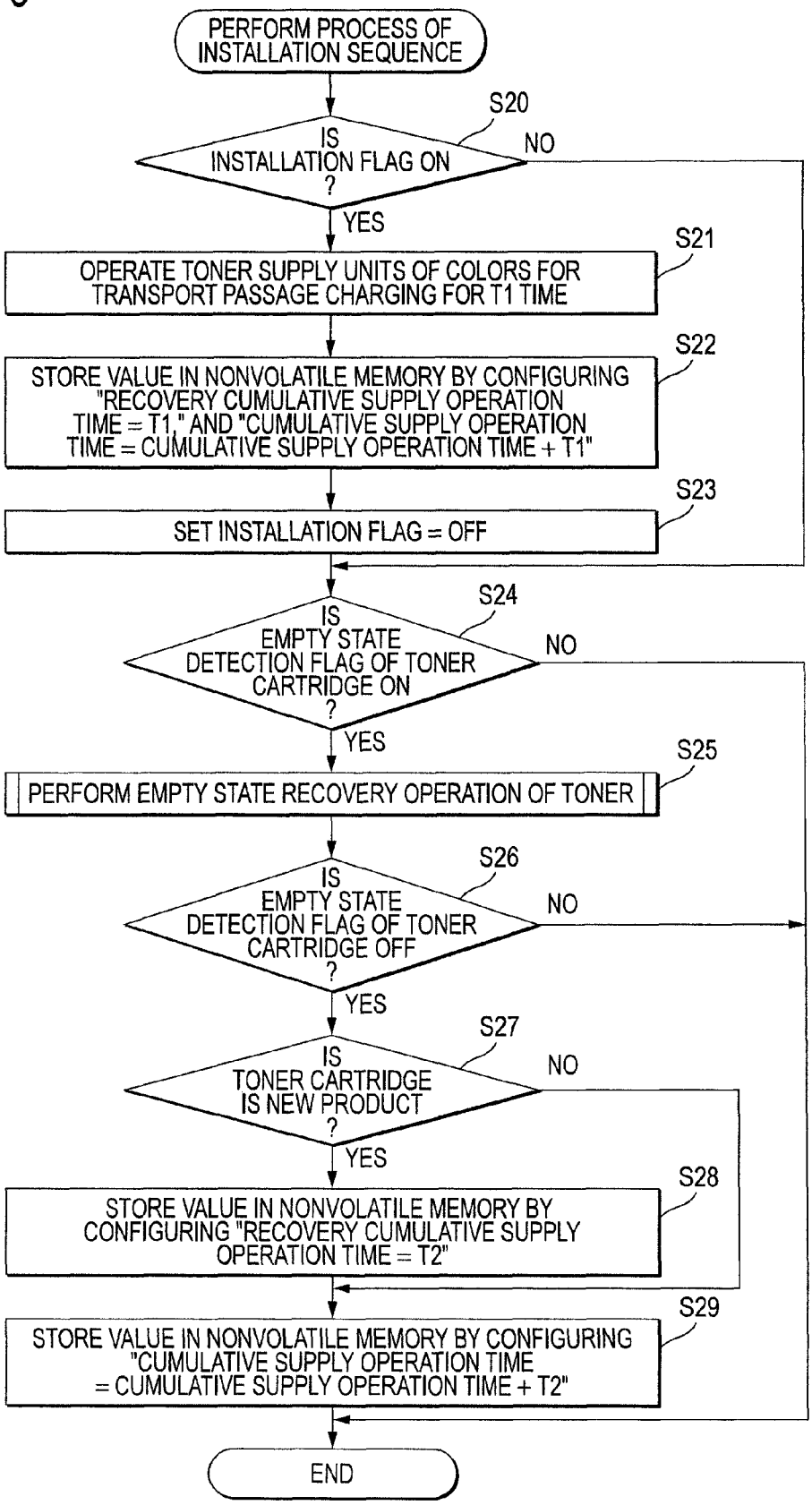
FIG. 10 is a flowchart illustrating a process sequence of installation sequence process.
Figure 11:
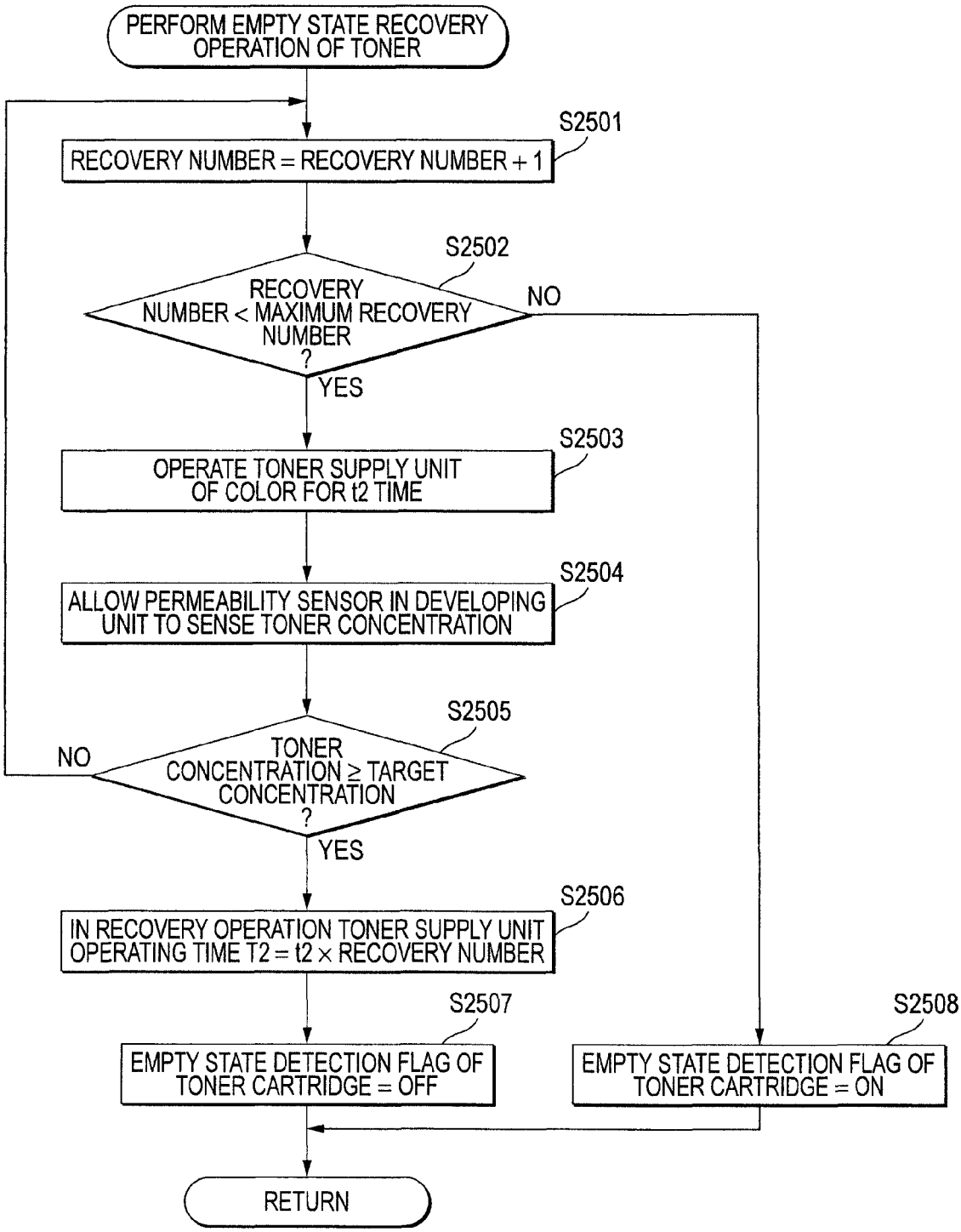
FIG. 11 is a flowchart illustrating a process sequence of a sub-routine for an empty toner state recovery operation.

FIG. 1 is a diagram illustrating the overall configuration of a full-color printer as an image forming device according to an exemplary embodiment of the present invention. FIG. 2A is a schematic sectional view illustrating a toner cartridge, a toner supply device, and a developing unit. FIG. 2B is a sectional view taken along the line A-A of FIG. 2A. FIG. 3 is a schematic sectional view illustrating a state where the toner cartridge is separated from the toner supply device. FIG. 4 is a flow chart illustrating a process sequence of a process of calculating a remaining toner quantity. FIG. 5 is a graph illustrating the variation of a level meter of the remaining toner quantity. FIG. 6 is a graph illustrating the variation of the remaining toner quantity. FIG. 7 is a block diagram illustrating a configuration of a control system which controls a supply of the toner and the state of the toner cartridge. FIG. 8 is an explanatory view illustrating a display example on a display panel. FIG. 9 is an explanation view illustrating a display example of the variation state of the toner remaining quantity. FIG. 10 is a flowchart illustrating a process sequence of installation sequence process. FIG. 11 is a flowchart illustrating a process sequence of a sub-routine for an empty toner state recovery operation.

First, with reference to FIG. 1, a schematic configuration of a full-color printer P, which is an example of the image forming device according to an exemplary embodiment of the invention, will be described.

In a chassis 1 of the full-color printer P, an image forming unit 10 which forms toner images of each color such as yellow (Y), magenta (M), cyan (C), or black (K), as an example of a visualizing agent; a paper feeding unit 30 which supplies a recording sheet 20 as a recording medium to the image forming unit 10; a fixing unit 40 which fixes the toner images transferred thereto when they pass through the image forming unit 10 onto the recording sheet 20 supplied from the paper feeding unit 30; and four toner supply units (an example of a second container and a developer supply unit) 50 (Y, M, C, and K) which supply toner of the respective colors to the developing units (an example of a first container) of the image forming unit 10 are arranged as a main unit of the printer. The units are supplied from a power supply unit 95 disposed in a lower side and controlled when such as a printer operating time by a control unit 90 constituted by a microcomputer. In the exemplary embodiment, the control unit 90 serves as a remaining toner quantity displaying control unit. As the remaining quantity displaying control unit, one-chip microcomputer can be provided as a separate component independent from the control unit 90.

In the image forming unit 10, photosensitive drums 11Y, 11M, 11C, and 11K are arranged in the vertical direction at regular intervals so as to form toner images of yellow, magenta, cyan, and black in an exclusive manner. In the vicinity of each photosensitive drum 11 (Y, M, C, and K), a charging roller 12 (Y, M, C, and K) which charges the surface of the photosensitive drum 11 (Y, M, C, and K) in a contact manner, and the image forming unit 10 having the developing unit 14 (Y, M, C, and K) which supplies a developer (toner) to a corresponding one of the photosensitive drums 11 (Y, M, C, and K) are disposed in the vertical direction at regular intervals.

Here, the photosensitive drum 11 (Y, M, C, and K) is a drum-shaped rotating member on which a photosensitive layer made of an organic photosensitive material or the like is formed. The photosensitive drum 11 rotates in a counterclockwise direction in FIG. 1. The charging roller 12 (Y, M, C, and K) is supplied with a predetermined charging voltage from the power supply unit 95.

Although not particularly limited, the developing unit 14 (Y, M, C, and K) may be a two-component developing unit which performs magnetic brush contact type development using a two-component developer having a toner T and a carrier. The developing unit 14 includes a mixing and transporting member (not shown) which mixes and transports the two-component developer contained in the device, a developing roller 15 (Y, M, C, and K: see FIG. 2 for reference) which retains the two-component developer transported by the mixed transport member and transports the developer to developing zones opposed to each of the photosensitive drums 11 (Y, M, C, and K), and the like.

The developing roller 15 (Y, M, C, and K) includes a rotating cylindrical-shaped sleeve and a magnet roller disposed inside the sleeve. The sleeve is supplied with a predetermined developing bias from the power supply unit 95.

In the image forming unit 10, an exposure unit 13 is disposed between the charging roller 12 (Y, M, C, and K) and the developing unit 14 (Y, M, C, and K) of the photosensitive drums 11 (Y, M, C, and K) so as to irradiate the surfaces of the photosensitive member 11 (Y, M, C, and K) with laser beam light LB from an optical system (not shown) so that electrostatic latent images of yellow, magenta, cyan, and black are formed the surfaces in accordance with an image signal. The exposure device 13 is supplied with, as a formal image signal, image information from an external connection device such as a personal computer connected to the printer P, wherein the image information being processed by an image processing unit in the control device 90.

In the image forming unit 10, a transfer device 100 is disposed so as to transfer toner images formed by the photosensitive drum 11 (Y, M, C, and K) to the recording sheet 20. The transfer device 100 includes, as a main part, a first primary intermediate transfer drum 21 which comes in contact with two photosensitive drums 11Y and 11M among four photosensitive drums 11, a second primary intermediate transfer drum 22 which comes in contact with two photosensitive drums 11C and 11K, a secondary intermediate transfer drum 23 which simultaneously comes in contact with the first primary intermediate transfer drum 21 and the second primary intermediate transfer drum 22, and a final transfer drum 24 which comes in contact with the secondary intermediate drum 23.

In the transfer device 100, the primary intermediate transfer drums 21 and 22 have a structure in which an elastic rubber layer made of a conductive silicon rubber is formed on a surface of a roller core having a cylindrical shape. The primary intermediate transfer drums 21 and 22 rotate in a clockwise direction in FIG. 1. The secondary intermediate transfer drum 23 has a structure in which an elastic rubber layer made of a conductive silicon rubber and a release layer made of fluorine rubber are formed on the surface of a roller core having a cylindrical shape. The secondary intermediate transfer drum 23 rotates in a counterclockwise direction. The final transfer drum 24 has a structure in which a cover layer made of urethane rubber is formed in the roller core. The final transfer drum 24 rotates in a clockwise direction In FIG. 1.

The intermediate transfer drums 21, 22 and 23 are supplied with a predetermined primary transfer voltage or a secondary transfer voltage from the power supply unit 95. The final transfer drum 24 is supplied with a predetermined third transfer voltage from the power supply unit 95. In the intermediate transfer drums 21, 22, and 23, a cleaning member (not shown) is disposed at a position opposed to the surfaces of the intermediate transfer drums so as to remove unnecessary attached particles attached thereon such as toner.

The paper feeding unit 30 includes a sheet feed tray 31 containing a plural recording sheets 20 and mounted on the paper feeding unit so that the recording sheets are drawn toward a front side (in the right side in FIG. 1) of the chassis 1 and a sheet discharge unit 32 which discharges the recording sheets 20 contained in the sheet feed tray 31 from the top portion thereof one by one.

The fixing unit 40 includes a heating roller 41 which is rotatably supported and in which a heating element such as a heating lamp or a halogen heater is disposed in a hollow of the roller 41; a pressing roller 42 which is rotatably supported while being pressed by the heating roller 41 in a pressing contact manner; and a paper discharge roller 43.

A dash-dotted line in FIG. 1 illustrates a sheet transport passage of the recording sheet 20. The sheet transport passage 101 is formed by a plural paper transport rollers 35 and 37, resist rollers 36, and paper transport guides (not shown). In the upper portion of the chassis 1, a delivery portion 1*a* which is configured as a curved slope surface formed to receive a stack of the fixed recording sheets 20 discharged out of the chassis 1.

A display panel 200 which serves as an operating unit is disposed on a front side (the right side in FIG. 1) of the upper portion of the chassis 1. Although not particularly limited, the display panel 200 may be a liquid display device, for example. The operating unit may be operated using a pressure-sensitive liquid crystal panel (that is a touch panel). However, the operating unit can be operated using a press button type liquid crystal panel.

Although detail descriptions thereof are given with reference to FIGS. 10 and 11, the remaining toner quantity is displayed as a level meter 200*k* of a bar graph on the display panel 200, the level meter capable of representing a state in which toner is gradually consumed from a full quantity state, for example. Although not particularly limited, other representation formats such as a level meter of a pie graph can be used, as long as they can inform visually users of the remaining toner quantity.

A power switch S which switches on/off a main power is disposed in a lower portion on the front side of the chassis 1.

Here, as shown in FIGS. 1 to 3, each of the four toner supply units 50 (Y, M, C, and K) includes holders 51Y, 51M, 51C, and 51K (see FIG. 2A) which detachably holds the cylindrical-shaped toner cartridge (developer container) 60Y, 60M, 60C, and 60K containing the toner of yellow, magenta, cyan, and black and which temporarily retains the toner in a corresponding one of the toner cartridges 60 (Y, M, C, and K); toner transport pipes 52Y, 52M, 52C, and 52K which are connected between the holder 51 (Y, M, C, and K) and the developing unit 14 (Y, M, C, and K); a spiral coil 53 (Y, M, C, and K) serving as the developer transport passage filling unit which conveys the toner retained in the holders 51 (Y, M, C, and K) to a corresponding one of the toner transport pipes 52 (developer transport passage); and spiral-shaped transport members 54Y, 54M, 54C, and 54K (see FIG. 2A) which transport the toner conveyed in the toner transport pipes 52 (Y, M, C, and K) toward a corresponding one of the developing units 14 (Y, M, C, and K).

As shown in FIG. 2A, an opening 14*a* is provided in each of the developing units 14 (Y, M, C, and K). A part of each developing roller 15 (Y, M, C, and K) is exposed to the outside via the opening 14*a*.

The toner cartridges 60Y, 60M, 60C, and 60K are usually of detachable type in which the cartridges are freely detachable from the holder 51 of the main body of the full-color printer P. However, the invention is not particularly limited to the above-mentioned type. The developer contained in the toner cartridge is usually toner of the two-component developer including the toner and the carrier. However, the developer may be a mixture of the toner and the carrier. Finally, the developer can be selected in accordance with requirement conditions to be provided to the developing unit as a destination of the developer.

In the toner supply unit 50, as long as the toner transport pipe 52 is disposed between the toner cartridges 60Y, 60M, 60C, and 60K and the developing units 14 (Y, M, C, and K), the invention is not particularly limited to the above-mentioned type.

As the toner transport pipe 52, one may be used which includes a retention section that temporarily retains the developer held in the toner cartridge and which is disposed between the retention section and the developing units 14 (Y, M, C, and K). The toner supply unit 50 is usually constructed such that a developer transport member (e.g., a spiral coil, a spiral-shaped small diameter screw, or the like) is disposed in the passage of the toner transport pipe 52, and the developer transport member is rotated by a rotatory driving device such as an electric motor. When the developer transport member is provided with the retention section, the developer transport member is disposed in both the retention section and the developer transport passage. However, as long as the developer can be transported along the developer transport passage independent from the developer transport member, the developer transport member may be disposed only in the retention section.

As long as the display panel 200 described later can display visually the remaining toner quantity to the user, the form thereof are not particularly limited. For example, it is desirable to display the remaining toner quantity by a level meter such as bar graph or a pie graph in consideration of visibility of the users.

Each holder 51 (Y, M, C, and K) in the toner supply unit 50 (Y, M, C, and K) includes a holder body 51*a* having a half-cylindrical shape and holding a lower half of each of the cylindrical-shaped toner cartridges 60 (Y, M, C, and K), and a toner retention section 51*b* formed to protrude from the bottom side of the holder body 51*a*. In one end of each holder body 51*a*, a toner cartridge mounting detection sensor 55 (Y, M, C, and K) detecting that the toner cartridges 60 (Y, M, C, and K) is mounted is attached, respectively. In addition, in the toner retention section 51*b*, a toner detection sensor 56 (Y, M, C, and K) detecting that a toner retained and discharged from the toner cartridge 60 (Y, M, C, and K) exists is attached, respectively (see FIG. 2B for reference).

As shown in FIG. 2A, the spiral coil 53 is wound in a rotation axis in a state where a toner conveyance blade is wound in a spiral, and can be rotatably attached in a bottom space of the toner retention section 51*b*. In addition, the spiral coil 53, as shown in FIG. 2, rotates by a rotational force of a dispenser motor 57 (Y, M, C, and K) transferred through a predetermined reduced gear line 58 (Y, M, C, and K). A step motor is usually used as the dispenser motor 57. However, other types such as a DC motor or an AC motor can be used, when it is necessary.

The toner transport pipe 52 is formed of a resin pipe having flexibility. One end of the toner transport pipe 52 is connected to a toner delivery port 51*c* of the retention section 51*b* of the holders 51 (Y, M, C, and K). The other end of the toner transport pipe 52 is connected to a toner receiving port 14*b* of the developing units 14 (Y, M, C, and K).

A spiral transport member 54 is a member (that is a coil having a spiral shape) formed of a linear metallic member wound in a spiral shape with a predetermined pitch, which is smaller than an inner diameter of the toner transport pipe 52, so that the spiral transport member 54 rotates while being inserted into the inside of the toner transport pipe 52. One end of the spiral transport member 54 is connected to a front end of the spiral coil 53. The other end of the spiral transport member 54 is connected to a free end. The spiral transport member 54 rotates in accordance with the rotation of the spiral coil 53.

The toner cartridge 60 (Y, M, C, and K), as shown in FIGS. 2 and 3, is of a detachable type that can be freely detached from a corresponding one of the holders 51 (Y, M, C, and K) of the toner supply units 50 (Y, M, C, and K). Specifically, the toner cartridge 60 (Y, M, C, and K) includes a cylindrical-shaped bottle body 61 which forms a toner discharge port 62 in a lower surface of one end, a covers 63 and 64 which covers both ends of the bottle body 61, an agitator 65 which is rotatably connected to the covers 63 and 64, and which is rotated so that the toner T is conveyed in the inside of the bottle body 61 toward the discharge port 62 (in the exemplary embodiment, attaching a film 65*b* contacted in an inner surface to the front end of a rotatory supporting body 65*a*, see FIG. 2B for reference).

The agitator 65 rotates after a gear 67 attached to one end of the agitator 65 is engaged with a part of the reduced gear line 58 and a rotational driving force of the dispenser motor 57 is applied. The toner cartridge 60 (Y, M, C, and K) is formed so as to be mounted in a state where a cover (not shown) detachably mounted on the delivery portion 1*a* of the chassis 1 is demounted, and the toner cartridge 60 (Y, M, C, and K) is placed in the holder 51 (Y, M, C, and K) of the toner supply unit 50 (Y, M, C, and K) exposed to the bottom of the toner cartridge 60 (Y, M, C, and K).

In the full-color printer P according to the present exemplary embodiment, as shown in FIGS. 2 and 3, as a storing unit so as to perform a situation management of the toner cartridge 60 (Y, M, C, and K), in the nonvolatile memory 80 (Y, M, C, and K), a warning threshold value (referred to as a toner life threshold value) W (Y, M, C, and K) configured individually are stored at toner cartridge 60 (Y, M, C, and K), respectively.

Here, the storing unit is a thing which is suitable for storing rewritably an amount of operations so that the amount of operations are accumulated and are rewritten at the time of supplying the warning threshold value and the toner by the toner supply unit 50. Although types or forms are not particularly limited to the above-mentioned types or forms, it is preferable that a nonvolatile memory element (e.g., a flash memory and the like) is used from the viewpoint of storing the memory.

The storing unit can be installed to a main body of the full-color printer P. However, it is desirable that a storing unit (state storing unit) attaching to a toner cartridge 60 side is used together in substitution for the storing unit of the main body side. In the full-color printer P using a plural kinds as a toner cartridge 60, for example, each storing unit corresponds to the toner cartridge 60 side so that characteristic information at the toner cartridges is stored, respectively and the stored information is used as indicated information to the toner cartridges 60 side. With such a configuration, it is desirable that the function of the storing unit of the toner cartridge 60 side is used.

In the respective memory 80 (Y, M, C, and K), an amount of operation (a first amount of operation) m1 (Y, M, C, and K) of the toner supply unit 50 (Y, M, C, and K) is cumulatively written as a predetermined count value. An amount of operation (a second quantity of operations) m2 (Y, M, C, and K) of the charging operation can be cumulatively written.

Here, the warning threshold value W shows an amount of operation of the toner supply unit 50 (Y, M, C, and K), when the toner is empty. The first amount of operation m1 shows a cumulative value of the toner supplying the operation amount of the toner supply unit 50 (Y, M, C, and K). The second amount of operation m2 shows an amount of operation of the discharging operation by the spiral coil 53 (Y, M, C, and K) which perform the charging operation filling the toner transport pipe 52 (Y, M, C, and K) with the toner conveyed from the toner cartridge 60 (Y, M, C, and K) in a predetermined time (e.g., when the initial power-up is performed the first power-up is performed).

Here, the first power-up includes the time when the body of the full-color printer P is a new product before operating the product, and the time when the toner transport pipe 52 is exchanged after maintenance or the toner transport pipe 52 is removed after cleaning the toner transport pipe so as to perform the first power-up.

A memory readable and writable device 81 (Y, M, C, and K) are installed in a predetermined portion such as the toner supply unit 50, which read out the information stored in the in the nonvolatile memories 80 (Y, M, C, and K) or write the information to the memories 80 (Y, M, C, and K) (information alteration).

The memory readable and writable device 81 (Y, M, C, and K) includes a readable and writable head portion 81*a*. In the holder 51 (Y, M, C, and K) of the toner supply unit 50 (Y, M, C, and K), an opening 51*e* is formed in a portion opposed to the head portion 81*a*.

The memory 80 and the memory readable and the writable device 81 (Y, M, C, and K) are connected to the control device 90 as shown in FIG. 7. With such a configuration, the read-out information stored in the nonvolatile memory 80 (Y, M, C, and K) can be inputted to the control device 90, or the necessary information contained from the control device 90 can be written to the memory 80 (Y, M, C, and K).

In the exemplary embodiment, as the memory readable and writable device 81, a non-contact type is used by the wireless type (specifically RFID, electromagnetic coupling type) between the nonvolatile memories 80. However, as the memory readable and writable device 81, a contact type can be used.

Here, a method of calculating the remaining toner ratio will be described.

In the present exemplary embodiment, Expression 1 showing the remaining toner on the basis of the warning threshold value W, the first amount of operation (operation time) m1, and the second amount of operation (operation time) m2

$$\text{A remaining toner ratio (\%)}=((W-m1)/(W-m2))\times 100 \qquad \text{Expression 1}$$

The remaining toner ratio is calculated by Expression 1. As the amount of the operation of the toner supply unit 50, the operation time and the operation state (e.g., rotation number, and the like) are used.

Here, when the full-color printer P is a new product, the toner T does not exist in the toner transport pipe 52 from the toner cartridge 60 to the developing unit 14. Accordingly, it is required that the toner discharging operation which discharging the toner T in the toner transport pipe 52 (referred to as an installation sequence or a recovery operation process) at the time of operating the device. At that time, the operation time of the toner supply unit 50 (charging operation time) is referred to as a second operation time m2. In addition, an operating time of the toner supply unit 50 so as to supply the toner T consumed by the printer operation is referred to as a first operation time m1.

Next, an order of calculating the remaining toner ratio will be described with reference to FIG. 4.

Firstly, when the remaining toner ratio calculating process is performed, the information from the nonvolatile memory 80 (Y, M, C, and K) of the toner cartridge 60 (Y, M, C, and K) is read out in S10. More specifically, the warning threshold value W (Y, M, C, and K) stored in the respective nonvolatile memory 80 (Y, M, C, and K), the operation time corresponding to the amount of the operation (the first amount operation) m1 of the toner supply unit 50 (Y, M, C, and K), and the operation time corresponding to the amount of the operation (the second amount of the operation) m2 of the discharging operation is read out, respectively, in accordance with the memory readable and writable device 81 (Y, M, C, and K).

Next, in Step S11, the respective information is substituted into Expression 1 so that the remaining toner ratio (%) is calculated, and then the process of Step S12 is performed.

In Step S12, it is determined whether the calculated remaining toner ratio is more than 100%. When the remaining toner ratio is more than 100%, the process of Step S13 is performed. Accordingly, "The remaining toner ratio is 100%" is displayed on a bar-graphed level meter 200K of the display panel 200. Then, the process ends. On the other hand, when the remaining toner ratio is not more than 100%, the process of Step S14 is performed. Then, it is determined whether the calculated remaining toner ratio is less than 0%.

When the remaining toner ratio is less than 0%, the process of Step S15 is performed. Accordingly, "The remaining toner ratio is 0%" is displayed on the bar-graphed level meter 200*k* of the display panel 200. Then, the process of Step S16 is performed. Accordingly, by lighting a toner supplying display 200*e* on the display panel 200 (see FIG. 8 for reference), informing the user that the toner cartridge 60 (Y, M, C, and K) should be charged. The process ends.

On the other hand, when the remaining toner ratio is not less than 0% in Step S14, the process Step S17 is performed. The indication of the remaining toner ratio (e.g., "remaining toner ratio 80%," "remaining toner ratio 10%," see FIG. 9 for reference) is displayed on the display panel 200 by the bar-graphed level meter 200*k* in accordance with the calculated remaining toner ratio. Then, the process ends.

FIG. 5 is a graph of a variation of a level meter illustrating the calculated result. FIG. 6 is a graph of illustrating an example of the variation of the remaining toner.

In FIG. 5, a normal case remaining quantity ratio is usually obtained based on the detected result of the toner sensor not using the corrected toner remaining quantity ratio as shown in Expression. 1 according to the present invention. A first consumption case is a case that discharges the toner to at least one of the toner transport pipe 52 or the developing unit 14 as a transport passage of the developer. That is, the first consumption case is a case consuming the toner, which discharges the toner to the transport pipe 52, even when the developing unit 14, the toner cartridge 60, and the toner transport pipe 52 are connected. When the developing unit 14 and the toner cartridge 60 are connected not through the toner transport pipe 52, the first consumption case is a case so as to discharge the toner to the developing unit 14. Accordingly, the first consumption case remaining quantity ratio is a value which is close to an actual toner remaining ratio of the toner cartridge 60. The remaining ratio after the correction process is a toner remaining ratio calculated by Expression 1. The normal case remaining quantity ratio and the first consumption case remaining quantity ratio correspond to the case when the second amount of operation does not exist in Expression 1 (remaining toner quantity (%)=((warning threshold value–cumulative operation time of the toner supplying device)× 100).

FIG. 6 illustrates the variation of the remaining quantity, when a toner capacity of the toner cartridge 60 is 45 grams. Accordingly, when the toner capacity of the toner cartridge 60 differs, the variation of the remaining quantity will be varied.

As shown in FIG. 5, the remaining toner ratio is 100% in a state where the printer does not print any page. In the display of the remaining toner quantity 200*k* on the display panel 200, "the remaining toner ratio 100% is displayed" as a following display unit for remaining quantity (see FIG. 9 for reference).

Here, as mentioned-later, after a new product of the e toner cartridges 60 (Y, M, C, and K) make the toner discharge port 62 opened, the toner cartridge 60 (Y, M, C, and K) is attached to the main body holder 51*a* of the holder 51 of the toner supply unit 50 (Y, M, C, and K). The toner discharging operation is performed so that the toner T in the toner cartridges 60 is substantially discharged in the toner transport pipe 52 through the retention section 51*b*. With such a configuration, the toner T is taken out from the toner cartridge 60 by the toner discharging operation. Actually, the remaining toner quantity of the toner cartridge 60 (Y, M, C, and K) is not 100% (full quantity).

However, when the remaining toner quantity is displayed by "80%" or "60%," a user feels unpleasant or distrust, "although though new cartridge is installed, why the new toner cartridge does not display 100%?," in a state where the printer does not print one page yet. Accordingly, in the invention, when the discharging operation is performed, the remaining quantity "100%" of the remaining toner display 200*k* is displayed on the display panel 200 by a compulsory control of the control device 90 regardless of the remaining toner quantity. With such a configuration, it is possible to remove effectively the unpleasant of the user.

The toner discharging operation is performed, when the full-color printer P is a new product or the new toner cartridges 60 (Y, M, C, and K) is mounted. After the toner transport pipes 52 (Y, M, C, and K) are changed after maintenance, or the toner transport pipes 52 (Y, M, C, and, K) are separated so as to clean the toner, the toner discharging operation (installation sequence or a recovery operation process) is performed. If the printer P is still used, when the remaining toner ratio is displayed by "0%" or an exchange warning of the toner cartridge 60 is displayed. After an excessive operation of the printer P is performed such that the toner is used up in the toner transport pipe 52, the toner discharging operation is performed. At this time, in a following situation management of the toner cartridge, when the toner discharging operation is performed and the toner cartridge 60 is a new product by detecting whether the mounted toner cartridges 60 (Y, M, C, and K) is a new product or not, the remaining toner quantity 100% is display to the remaining toner display 200*k* regardless of the remaining toner quantity. However, when it is decided that the toner cartridge 60 is not a new product (at the time of using the toner cartridge 60), the remaining toner quantity is displayed in accordance with the calculated remaining toner ratio by Expression 1.

In addition, in a state where the toner cartridges 60 (Y, M, C, and K) is mounted, when the toner T is gradually consumed corresponding to the number of the printed sheets, the remaining toner quantity is displayed in accordance with the calculated remaining toner ratio (corrected residual ratio as shown in FIG. 5 by Expression 1)

However, as shown the graph of FIG. 5 illustrating the variation of the level meter, when the number of the printed sheet is "0" in an initial state, the general case residual ratio and the corrected residual ratio start from "100%." When the remaining toner ratio reaches "0%," a the general case residual ratio is about 2400 sheet. Actually, when the remaining toner ratio is about "0%," which is about 2100 sheet, a misalignment having 300 sheets is generated. On the contrary, when the corrected residual ratio calculated on the basis of Expression 1 is about "0%," the corrected residual ratio can be adjusted about 2100 sheets. When the remaining toner ratio is set to "0%," the corrected residual ratio of the toner is set to the actual remaining toner ratio. With such a configuration, it is possible to maintain the detection accuracy of the empty toner.

The discharging operation is not particularly limited. However, for example, the timing to perform the discharging operation can be performed, when the full-color printer P is a new product and an initial power is supplied (an initial turn-on operation of the power supply switch S). In addition, the discharging operation can be performed at the time of supplying the initial power, after the toner transport pipe 52 (Y, M, C, and K) is exchanged by the maintenance, or the toner transport pipe 52 (Y, M, C, and K) are removed and cleaned.

In addition, the full consumption of the toner in the toner cartridge 60 (Y, M, C, and K) is detected by that a toner detection sensor (detection sensor in an empty state) 56 (Y, M, C, and K) detects "Toner is empty."

Although not particularly limited, as the toner detection sensor 56, a permeability sensor can be used. When the permeability sensor is used, for example, a concentration is determined by the permeability sensor provided in the developing unit 14 (Y, M, C, and K) or in the vicinity of the developing unit. When it is determined that the concentration of the toner is less than a predetermined concentration, the permeability sensor determines that "Toner is empty" in the toner cartridge 60 (Y, M, C, and K).

Here, in accordance with the above-mentioned permeability sensor, when it is detected that the toner cartridge 60 is empty and the toner cartridge 60 is a non-used product (new product) by the developer container confirming unit that includes the nonvolatile memory 80 on the toner cartridge 60 side and the memory readable and writable device 81, the toner discharging operation is performed and the remaining toner quantity "100%" can be forcibly displayed to the remaining toner display 200*k* on the display panel 200.

Next, a control system which supplies the toner and manages the toner cartridge state will be described with reference to a block diagram of FIG. 7.

In the exemplary embodiment, the control system which supplies the toner and manages the toner cartridge state is attached as a part of the control device 90 controlling the respective part. Although not particularly limited, for example, in the control system which supplies the toner and manages the toner cartridge state, which can be constituted by one-chip microcomputer and can be independently constituted from the control device 90.

Here, the control device 90 constituted by the microcomputer includes a memory unit 91 which has ROM storing the control program or RAM capable of storing rewritably the control information or various information.

In addition, in the control device 90, the toner cartridge mounting detection sensor 55 (Y, M, C, and K), the toner detection sensors 56 (Y, M, C, and K), a concentration sensor 29 are connected, respectively, other than a power supply switch S manipulating the main power supply with on-off operation or an interlock open-close detection sensor 18.

With such a configuration, the operation information of the power supply switch S or the respective detection information is inputted from the toner cartridge mounting detection sensor 55 (Y, M, C, and K), the toner detection sensor 56 (Y, M, C, and K). An evaluation value is inputted from the concentration sensor 29.

The concentration sensor 29 can be constituted by a reflective concentration sensor provided opposed to the photosensitive drum 11 (Y, M, C, and K). When it is determined that a standard patch provided on the photosensitive drum 11 (Y, M, C, and K) is thin for a plural times, the concentration sensor 29 determines that the toner T is empty.

When it is determined that the toner T is empty on the basis of the detected information from the concentration sensor 29 and the toner cartridge 60 is a non-used product (new product) in accordance with the nonvolatile memory 80 on the toner cartridge 60 side constituting the developer container confirming unit and the memory readable and writable device 81, the toner discharging operation is performed and the remaining toner quantity "100%" can be forcibly displayed to the remaining toner quantity display 200*k* on the display panel 200.

That is, when the exchange operation for the toner cartridge 60 (Y, M, C, and K) is performed by the user, a recovery process (recovery operation process: see a flowchart in FIG. 11 for reference), in which a toner concentration (TC %) is recovered to a normal range in the developing unit 14 (Y, M, C, and K), is required. Accordingly, the toner supply unit 50 (Y, M, C, and K) is operated so that the toner T is supplied to the developing unit 14 (Y, M, C, and K) through the toner transport pipe 52 (Y, M, C, and K) from the toner cartridge 60 (Y, M, C, and K). In addition, until the concentration is in a predetermined standard, the concentration sensor 29 repeats that the concentration of the standard patch is read in a plural times. With such a configuration, a print operation is normally performed. During the above-mentioned operation, the operation time (discharging operation time) of the toner supply unit 50 (Y, M, C, and K) is defined as the second operation time m2, and the operation time of the toner supply unit 50 for supplying the toner T consumed by the followed print operation is defined as the first operation time m1. In addition, until the print operation is performed again, the remaining toner ratio is forcibly displayed by 100%, and the first operation time m1 and the second operation time m2 are substituted into Expression 1 so that the remaining toner ratio is calculated. Accordingly, the remaining toner display 200*k* is displayed after operating the print as shown in FIG. 10 on the basis of the remaining toner ratio. With such a configuration, it is possible to remove effectively the unpleasant feeling of the user, so that the display of the remaining toner and the detection of the empty toner state can be enhanced.

On the other hand, in the control device 90, a dispenser motor driving controller 75 (Y, M, C, and K) which controls the driving of a dispenser motor 57 (Y, M, C, and K) and a memory readable and writable device 81 (Y, M, C, and K) are connected to each other, so that a predetermined control signal can be transmitted.

The display panel 200 as display unit is connected in the control device 90, so that a display signal can be transmitted in a predetermined timing. As a general display unit, as above-mentioned display panel 200 is used, which is provided in a predetermined portion of the chassis 1. Although not particularly limited, for example, a display unit (representation display) of an external connection device (calculator such as personal computer) connected to the full-color printer P can be used.

The control device 90 can provide all the function to the full-color printer P or to the external connection device. On the other hand, a part of the function of the control device 90 is provided in the full-color printer P and the remaining function of the control device 90 can be provided in the external connection device.

Here, an example of a configuration and a display for the display panel 200 will be described with reference to FIGS. 8 and 9.

In FIG. 8, a display of magnification 200*a* which displays orderly the magnification from the left of the display panel 200, a display of the paper selection of the copying paper 200*b* which displays a kind of trays, a display of paper size 200*c* which displays the paper size, a display of paper direction 200*d*, a display of a toner replenishing 200*e* which turns the light on, when the toner is used up, a display of paper jam 200*f* which informs an occurred position of the paper jam, a display of copy 200*g* which displays an state capable of being copied with a character by a duplicator after the power supply switch S is turned "on," a display of wait 200*h* which displays a prior state which is a state before displaying the display of copy 200*g* using characters, a display of countering the copying number 200*i* which display the copying number, a display of concentration 200*j* which displays a level of the concentration, and a display of remaining toner quantity 200*k* which displays the remaining toner quantity in the toner cartridge to a bar-graphed level meter are disposed.

A pressing type switch is provided in a predetermined display unit (e.g., the display of magnification 200*a*, the display of paper selection 200*b*, and the display of paper size 200*c*) on the display panel 200. With such a configuration, the user can touch the switch using a finger so as to select a necessary configuration. In addition, an additional configuration button is provided in the vicinity of the display panel 200, so that a necessary configuration is selected in accordance with the operation of the configuration button.

In the exemplary embodiment shown in FIG. 8, one remaining toner display 200*k* is provided. For example, the user performs a predetermined button operation so that the remaining toner information of the toner cartridge 60 (Y, M, C, and K) to know the remaining toner quantity can be selected. In addition, the remaining toner display 200*k* can be displayed by installing four graph corresponding to respective colors of the toner cartridges 60 (Y, M, C, and K). With such a configuration, the user can know the remaining toner quantity of the respective colors. Accordingly, convenience can be increased.

Next, with reference to FIG. 9, a display example of displaying the variation of the remaining toner to the remaining toner display 200*k* will be described.

As shown in FIG. 9, a bar-graphed level meter is orderly displayed from the left side, a full quantity (remaining toner quantity 100%)→(remaining toner quantity 90%)→(remaining toner quantity 80%)→(remaining toner quantity 10%)→(remaining toner quantity 5%)→the toner empty state (remaining toner quantity 0%), in accordance with the remaining toner ratio calculated by Expression 1. Accordingly, it is possible that the user can know visually the reduced state which indicates the remaining toner quantity.

The display frequency of the remaining toner quantity (detailed degree of the level) can be optionally displayed. The display level can be described in detail (e.g., displayed by one percent) or can be roughly described (e.g., 100%→50%→20%→0%).

The display type of the remaining toner display 200*k* is not particularly limited to the bar-graph type. Various display types such as a level meter having pie graph type can be used, which can visually notify the user of the remaining toner quantity.

A printer having a full color image according to the exemplary embodiment of the above-mentioned full-color printer P will be performed hereinafter.

Firstly, in the image forming unit 10, after four photosensitive drums 11 (Y, M, C, and K) is uniformly charged by the charging rollers 12 (Y, M, C, and K), the laser beam light are irradiated, respectively, corresponding to the yellow (Y), the magenta (M), the cyan (C), and the black (K) from the exposure unit 13 to the surface of the photosensitive drums 11 (Y, M, C, and K). With such a configuration, an electrostatic latent image is formed in accordance with the inputted information to the printer P. Next, the electrostatic latent images on the photosensitive drums 11 (Y, M, C, and K) are developed in accordance with the developing unit 14 (Y, M, C, and K) so as to be visualized as the toner image of the respective color of the yellow, magenta, cyan, and black.

Continuously, the toner images formed on the photosensitive drums 11 (Y, M, C, and K) are electrostatically primary-transferred transferred on the first primary intermediate transfer drum 21 and the second primary intermediate drum 22. That is, the toner images of the yellow color and magenta color formed in the photosensitive drums 11Y and 11M are transferred on the first primary intermediate transfer drum 21. The toner images of the cyan color and the black color formed in the photosensitive drums 11C and 11K are transferred on the second primary intermediate transfer drum 22. With such a configuration, the toner image of the magenta color and the toner image of the yellow color are formed on the first primary intermediate transfer drum 21. The toner image of the cyan color and the toner image of the black color are formed on the second primary intermediate transfer drum 22.

Continuously, the toner images formed on the first primary intermediate transfer drum 21 and the second primary intermediate transfer drum 22 are electrostatically secondary-transferred on the secondary intermediate transfer drum 23. With such a configuration, the toner image (yellow, magenta) on the primary intermediate transfer drum 21 and the toner image (cyan, black) on the secondary intermediate transfer drum 22 are transferred on the secondary intermediate transfer drum 23, respectively, so that a toner image of four colors (yellow, magenta, cyan, and black) are formed. Next, the toner image of the four colors are transferred toward a final transfer portion which is pressure-contact portion between the secondary intermediate transfer drum 23 and the final transfer drum 24 in accordance with the rotation of the secondary intermediate transfer drum 23.

When the toner image is formed in a predetermined timing in the image forming unit 10, the recording sheet 20 is supplied toward the final transfer portion from the paper feeding unit 30. That is, after the recording sheet 20 contained in the sheet feed tray 31 is delivered to the sheet transport passage 101 by the sheet discharge unit 32 and is paused in the resist roller 36, the recording sheet 20 is transferred to the final transfer unit by the resist roller 36 in a predetermined timing. With such a configuration, the toner image of the four colors (yellow, magenta, cyan, and black) on the secondary intermediate drum 23 is electrostatically third-transferred in a state where the toner image is pressed into the recording sheet 20 transported to the final transfer unit which is a pressure-contact portion between the secondary intermediate transfer drum 23 and the final transfer drum 24.

Next, the recording sheet 20 transferring the toner image of the four colors is transported to the fixing unit 40, passes through the heating roller 41 and the pressing roller, so that the recording sheet 20 is discharged to the delivery portion 1*a* after the fixing is performed by the heat and the press. The above-mentioned image forming process is performed, so that the full color image is formed on the recording sheet 20.

Next, a configuration and an operation of the toner supplying will be described.

In the full-color printer P, by repeating the above-mentioned image forming processes, the toner in the developing units 14 (yellow, magenta, cyan, and black) is reduced. With such a configuration, the toner supplying of the respective colors (e.g., toner supplying corresponding to the consumed toner quantity) is performed by the toner supply unit 50 (Y, M, C, and K) in a predetermined timing.

The toner supplying in the full-color printer P is basically constituted so that image signal quantity (video signal) transmitted from the image processing device in the control device 90 to the exposure unit 13 is counted, the consumed toner quantity is estimated on the basis of the counted value. Accordingly, the toner supplying is performed by the control operation of the control device 90 on the basis of the estimated information. That is, the count value in the toner supply unit (Y, M, C, and K) 50 is calculated into a converted value for an additional amount of operation (rotation number or rotation time) of the dispenser motor 57. Next, at the time of performing the print operation (work), the toner supplying is performed by operating the dispenser motor 57 (Y, M, C, and K) for a predetermined time on the basis of the additional amount of operation.

After standard toner images (patch) for controlling the concentration are formed, respectively, and are transferred to the intermediate transfer drum (e.g., final transfer drum 24), the toner supplying is performed so that an image concentration is calculated using an optical concentration detection sensor (not shown) on the transfer drum, and the toner supply quantity is properly adjusted in accordance with the control operation of the control device 90 on the basis of the information result. That is, comparing the estimated value of the patch concentration and the standard value is performed. Then, when the measurement value is under the standard value (having low concentration), the toner replenishing quantity (an amount of operation for replenishment of the dispenser motor 57) is properly increased to some extent at the time of performing the next print operation. Then, the toner is actually replenished. On the contrary, when the measurement value is higher the standard value (high concentration), the toner replenishment quantity is decreased to some extent at the time of performing the next print operation. Then, the toner is actually replenished. The patch formation and the concentration measurement are performed, when the number of cumulative print sheet reach a predetermined number.

With such a configuration, when there is a need of the toner supplying (need of driving in dispenser motor 57), the dispenser motor 57 rotates by a predetermined amount of operation in the toner supply unit 50.

With such a configuration, the toner T of the respective color contained in the toner cartridges 60 (Y, M, C, and K) are dropped so as to be retained from the toner discharge port 62 of the bottle body 61 to the toner retention section 51*b* of the holder 51 of the toner supply unit 50 corresponding to a rotation of the agitator 65. With such a configuration, the toners T retained in the retention section 51*b* of the holders 51 are transferred to the toner transport pipe 52 in accordance with the spiral coil 53 rotated by the rotation driving of the dispenser motor 57. Then, the toner T of the respective colors is transferred by the spiral transport member 54 in the toner transport pipes 52 (e.g., spiral-shaped coil which is formed by winding the line member in the form of a spiral shape). As a result, the toner T of the respective colors (yellow, magenta, cyan, and black) is replenished to the developing unit 14 through the toner transport pipes 52 (Y, M, C, and K).

By replenishing repeatedly the toner, when the toner T is removed in the toner cartridge 60 (Y, M, C, and K), the used-up toner cartridge 60 are demounted from the holder 51 so that a new toner cartridge 60 is mounted on the holder 51.

Next, a toner charging operation and a management of the toner cartridge state will be described.

In the full-color printer P, before using the printer P, a following toner charging operation (hereinafter, simply referred to as "charging operation" or "installation sequence") will be automatically performed.

Firstly, the installation sequence is an operation (charging operation) that charges properly the toner T in the toner cartridges 60 (after the toner discharge port 62 is opened) into the toner transport pipes 52 through the retention section 51*b* of the holders 51 after the toner cartridges 60 (Y, M, C, and K) are mounted on the main body 51*a* of the holders 51 of the toner supply units 50 (Y, M, C, and K).

Here, after the toner cartridges 60 (Y, M, C, and K) of a new product make the toner discharge port 62 opened, the toner cartridges 60 (Y, M, C, and K) are mounted on the main body 51*a* of the holder 51, a toner charging operation is performed so as to charge properly the toner T in the respective toner cartridge 60 into the toner transport pipes 52 through the retention section 51*b* of the holder 51. With such a configuration, since the toner T is taken out from the toner cartridge 60 by the toner charging operation, the remaining toner quantity of the toner cartridge 60 (Y, M, C, and K) is not actually 100% (full quantity). However, although the printer does not print one page, the user may feel unpleasant at the time of watching that the remaining toner display is "80%" or "60%." Accordingly, when the toner charging operation is performed, the remaining toner quantity is displayed "100%" to the toner remaining display 200*k* on the display panel 200 by the forcibly control of the control device 90 regardless of the actual toner remaining quantity. With such a configuration, it is possible to effectively reduce the unpleasant feeling of the user.

The installation sequence (toner charging operation or recovery operation process) is only performed, when the full-color printer P is a new product or the toner cartridges 60 (Y, M, C, and K) of a new product is installed. Additionally, for example, after the operation in which the toner transport pipe 52 (Y, M, C, and K) is exchanged after the maintenance or the toner transport pipe (Y, M, C, and K) is demounted so that the cleaning is performed, the toner charging operation is performed.

The installation sequence is performed such as a different condition (an amount of operation) by considering that the full-color printer P includes a plural toner supply unit 50 (Y, M, C, and K), and a path length of the toner transport pipes 52 (Y, M, C, and K) of the toner supply device is different, and the like.

For example, in the exemplary embodiment, the respective path length L1, L2, L3, and L4 of the toner transport pipes 52Y, 52M, 52C, and 52K have a length relationship like "L1<L2<L3<L4." With such a configuration, the amount of operation of the installation sequence in the toner supply unit 50 (Y, M, C, and K) is performed a lot, as the toner transport pipe 52 has a long shape. That, the amount of operation is basically configured so that the spiral coil 53 or the transport member 54 is rotated so as to convey surely the toner to the toner transport pipe 52 in accordance with an driving of the dispenser motor 57.

In addition, in the printer, the management of the toner cartridge state is performed, which watches a used state (remaining state) of the toner cartridges 60 (Y, M, C, and K) and warns an exchange timing of the toner cartridges 60.

The management of the toner cartridge state is performed by storing that the amount of operation of the toner supply units 50 (Y, M, C, and K) to the nonvolatile memory 80 (Y, M, C and K), and judging the quantity of the stored operation reaches a predetermined warning threshold value W. For example, the toner cartridge management is performed, which warns the exchange of the toner cartridge 60.

When the user performs the exchange operation for the toner cartridge 60 (Y, M, C, and K), it is necessary that the toner concentration (TC %) in the developing unit 14 returns a normal range. Accordingly, the toner supply unit 50 (Y, M, C, and K) is operated so that the toner T is supplied to the developing unit 14 (Y, M, C, and K) from the toner cartridge 60 (Y, M, C, and K) through the toner transport pipe 52 (Y, M, C, and K). In addition, the concentration sensor 29 repeatedly reads the concentration of a standard patch until the concentration is in a predetermined standard, a print operation normally returns. Herein, a driving time (charging operation time) of the toner supply unit 50 (Y, M, C, and K) between the operation is defined as a second operation time m2. A driving time of the toner supply unit 50 so as to supply the consumed toner T with the latter print operation is defined as a first operation time m2. Until the print operation is performed, the remaining toner ratio is forcibly displayed "100%," the first operation time m1 and the second operation time m2 are substituted into Expression 1 so that the remaining toner ratio is calculated. Accordingly, the remaining toner display 200*k* is performed after performing the print operation, as shown in FIG. 9, on the basis of the remaining toner ratio. With such a configuration, it is possible to effectively remove the unpleasant feeling of the user, to effectively display the remaining toner quantity, and to effectively detect a state of the empty toner.

Here, with reference to the flowchart of FIGS. 10 and 11, a process sequence of the installation sequence process will be described.

When the toner cartridge 60 (Y, M, C, and K) is attached to the holder 51 (Y, M, C, and K), the sequence process is performed. Accordingly, in Step 20, it is detected that an installation flag is "on." When the detected result is "No," the process of Step S24 is performed. When the detected result is "Yes," the process of Step S21 is performed.

In Step S21, after the toner supply units 50 (Y, M, C, and K) for charging the transport passage are operated by T1 time, the process of Step S22 is performed.

In Step S22, by configuring that a cumulative supply time of the recovery=T1, a cumulative supply operation time=a cumulative supply operation time+T1, the configured value is stored in the nonvolatile memories 80 of the toner cartridge 60 (Y, M, C, and K). Then, process of Step S23 is performed. The process of Step S24 is performed after the installation flag is turned "off."

In Step S24, it is detected whether an empty state detection flag of the toner cartridge is "on," or not. When the detected result is "No," that is, it is detected that the toner cartridge 60 (Y, M, C, and K) is not empty, the process ends.

On the other hand, when the detected result is "Yes," that is, it is detected that the toner cartridge 60 (Y, M, C, and K) is empty, the process of Step S25 is performed. Accordingly, a sub routine of the recovery operation process of the empty toner is performed.

Here, with reference to FIG. 11, the recovery operation process of the empty toner will be described.

When the process is performed, the number of the recovery increases by one in Step S2501, that is "recovery number=recovery number+1." Then, the process of Step S2502 is performed.

In Step S2502, it is detected that the number of recovery is less than a maximum number. When the detected result is "No," the process of S2508 is performed. The empty state detection flag of the toner cartridge is turned "On." The process of the installation sequence of FIG. 10 is performed.

On the other hand, in Step S2502, when the detected result is "Yes," the process of S2503 is performed. After the toner supply unit 50 (Y, M, C, and K) of the respective colors are operated for t2 time, the process of Step S2504 is performed.

In Step S2504, the process of Step S2505 is performed using permeability sensor constituting the toner detection sensor 56 disposed in the developing unit 14 (Y, M, C, and K).

In Step S2505, it is detected that the concentration of the toner is a target concentration or more. When the concentration of the toner does not reach the target concentration, the process of Step S2501 is performed so that the same process is repeatedly performed. When the concentration of the toner is the target concentration or more, the process of Step S2506 is performed.

In Step S2506, the operation time of the toner supply unit in the recovery operation is defined as "t2=t2×the number of the recovery." Then, the process of Step S2507 is performed. The empty state detection flag of the toner cartridge is turned "off." Then, the process of the installation sequence of FIG. 10 is performed.

In the exemplary embodiment of FIG. 11, using the permeability sensor as a toner detection sensor is explained. Although, not particularly limited, it is possible to perform the same process, even when using the concentration sensor 29. At that time, a standard patch is made on the photosensitive drum 11 (Y, M, C, and K) on behalf of the process of Step S2504, the standard patch is sensed using the concentration sensor 29. Accordingly, on behalf of Step S2505, a process is performed in which it is detected that the standard patch concentration is more than the target concentration.

Continuously, a following process after Step S26 in FIG. 10 will be described.

In the empty state of the toner, after performing the sub routine of the recovery operation process, the process of Step S26 is performed. It is detected whether or not the empty state detection flag is "off." When the detected result is "No," the process ends. When the detected result is "Yes," the process of Step S27 is performed.

In Step S27, it is detected that the toner cartridge 60 (Y, M, C, and K) is a new product. When the toner cartridge is not a new product, the process of Step S29 is performed. It is defined that "the cumulative supply operation time=cumulative supply operation time+T2." The above-mentioned value is stored in the nonvolatile memory 80 of the toner cartridges 60 (Y, M, C, and K) so that the process ends.

On the other hand, in Step S27, when it is detected that the toner cartridge is a new product, the process of Step S28 is performed. By defining that "cumulative recovery time=T2," the value is stored in the nonvolatile memory 80 of the toner cartridge 60 (Y, M, C, and K). Then, the process of Step S29 is performed. By defining "cumulative supply operation time=cumulative supply operation time+T2," the value is stored in the nonvolatile memory 80 of the toner cartridge 60 (Y, M, C, and K). Then, the process ends.

On the basis of the detection information of the permeability sensor or the concentration sensor 29, when it is detected that the toner T is an empty state and the toner cartridge 60 is a new product using the nonvolatile memory 80 and the memory readable and writable device 81, the process of charging operation of the toner is performed and the process of displaying the full quantity "100%" on the toner remaining display 200*k* of the display panel 200. With such a configuration, it is possible to effectively remove the unpleasant feeling of the user and to effectively display the remaining toner quantity and the empty state detection of the toner.

While the present invention has been particularly shown and described with reference to exemplary embodiments thereof, it will be understood by those skilled in the art that various changes in form and details may be made therein without departing from the spirit and scope of the invention as defined by the appended claims. That is, the exemplary embodiments should be considered in descriptive sense only and not for purpose of limitation. Therefore, the scope of the invention is defined not by the detailed description of the invention but by the appended claims, and all differences within the scope will be construed as being included in the present invention.

For example, an image formed by the image forming apparatus is transmitted to a recording sheet through a direct-transfer medium an intermediate transfer medium so that a necessary image is formed. Although not particularly limited to the types, and the like. Specifically, the image forming apparatus may independently have a plural associations of the developer container and the developer supply unit, when forming a color image using a toner having a plural different colors.

Accordingly, it is possible that a whole or part of a function may be performed using an external device (e.g., a personal computer connected to the image processing device, and the like).

When using a program, it is possible that the program is provided through a network or is stored to a recording medium such as CD-ROM.

The image forming apparatus according to the invention can be applicable to a developing image forming apparatus, a transfer image forming apparatus, a charging image forming apparatus, and the like. In addition, the image forming apparatus can be applicable to a laser printer, a full-color printer, a duplicator, and the like. The image forming apparatus can also be applicable to an ink-jet printer using the visualizing agent, that is, an ink-jet printer in which an ink head injecting an ink and an ink tank charging the ink are connected, the ink is supplied from the ink tank to the ink head corresponding to a reduced ink.

What is claimed is:

1. An image forming apparatus comprising:

an image carrying body on which an electrostatic latent image corresponding to image information is formed;

a developing unit that visualizes the electrostatic latent image formed on the image carrying body with a toner;

a developer container that contains a developer including the toner;

a developer supplying unit that supplies the developer from the developer container to the developing unit through a developer transport passage;

a developer transport passage filling unit that fills the developer transport passage with the developer supplied from the developer container at a predetermined time;

a control unit;

a display unit that displays a remaining quantity of the developer in the developer container;

an empty state detecting sensor that detects whether or not the developer container is empty; and a developer container checking unit that judges whether or not the developer container is unused; and a state storing unit that stores information indicating the remaining quantity of the developer, wherein the control unit calculates a remaining developer ratio based on an operation amount of the developer supplying unit, the control unit performs an operation of controlling the display unit to display the remaining quantity of the developer in the developer container, based on the remaining developer ratio, the control unit performs an operation of controlling the display unit forcibly to display information indicating that the developer container is full regardless of the remaining developer ratio, when the developer transport passage filling unit fills the developer transport passage with the developer supplied from the developer container at the predetermined time, and the display unit displays the remaining quantity of the developer in the developer container, wherein the predetermined time indicates a time after the empty state detecting sensor has detected that a previous developer container is empty, when the developer container checking unit judges that the developer container is unused, wherein the developer container checking unit judges whether or not the developer container is unused based on the information read from the state storing unit, wherein the remaining developer ratio is calculated by the following equation, $$\text{the remaining developer ratio}(\%) = \frac{(\text{warning threshold value} - \text{first operation amount})}{(\text{warning threshold value} - \text{second operation amount})} \times 100$$

where a first operation amount is a cumulative amount of the operation of supplying the developer by the developer supplying unit, a second operation amount is an amount of the operation of filling the developer transport passage with the developer by the developer supplying unit at a predetermined time, and a warning threshold is an amount of the operation of supplying the developer by the developer supplying unit until the developer container is empty, and the state storing unit that stores information indicating the remaining quantity of the developer, the warning threshold, the first operation amount, and the second operation amount.

2. The apparatus according to claim 1, further comprising a memory unit that stores the warning threshold, the first operation amount, and the second operation amount, wherein the warning threshold, the first operation amount and the second operation amount are rewritable.

3. The apparatus according to claim 1, wherein the predetermined time indicates a time when the image forming apparatus is turned on first after installed.

4. The apparatus according to claim 1, further comprising: a concentration sensor disposed opposite to the image carrying body so as to sense a concentration of the toner; and developer container checking unit that judges whether or not the developer container is unused; wherein the predetermined time indicates a time when the concentration sensor detects that the toner in the developer container is empty based on the concentration of the toner sensed by the concentration sensor, and the developer container checking unit judges that the developer container is unused.

5. The apparatus according to claim 1, wherein the developer transport passage filling unit is external to the developer container.

6. The apparatus according to claim 1, wherein the developer transport passage is a developer transport pipe.

* * * * *